US006835087B2

(12) United States Patent
Yamawaki

(10) Patent No.: US 6,835,087 B2
(45) Date of Patent: Dec. 28, 2004

(54) LOCKING MECHANISM FOR ELECTRICAL CONNECTOR

(75) Inventor: Takanori Yamawaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/345,350

(22) Filed: Jan. 16, 2003

(65) Prior Publication Data

US 2004/0142591 A1 Jul. 22, 2004

(51) Int. Cl.[7] ..... H01R 13/627

(52) U.S. Cl. ..... 439/358

(58) Field of Search ..... 439/358, 350, 439/357, 488, 352

(56) References Cited

U.S. PATENT DOCUMENTS 6,332,800 B2 * 12/2001 Kodama ..... 439/357

FOREIGN PATENT DOCUMENTS

JP 64-49906 3/1989

* cited by examiner

*Primary Examiner*—P. Austin Bradley
*Assistant Examiner*—Phuongchi Nguyen
(74) *Attorney, Agent, or Firm*—Armstrong, Kratz, Quintos, Hanson & Brooks, LLP

(57) ABSTRACT

A front projection 45 and a rear projection 46 are formed facing each other as locking members in one (female type) connector housing 39. A locking projection 29 of a locking arm 27 of the other (male type) connector housing 11 engages with a space between said projections 45 and 46. Both a front surface 29*a* of the locking projection 29 and the rear projection 46 are formed into taper shapes, and abut each other. Either a rear end surface 29*b* of the locking projection 29 or the front projection 45 abutting against the rear end surface 29*b* is formed into an inverse taper side. The locking arm 27 is supported in a middle fulcrum part 31 raised from the male type connector housing 11, and connecting parts 33 and 34 connected to the connector housing 11. The locking projection 29 is positioned in between the middle fulcrum part 31 and the connecting parts 33 and 34.

4 Claims, 5 Drawing Sheets

LOCKING MECHANISM FOR ELECTRICAL CONNECTOR

BACKGROUND OF THE INVENTION

1. Field of the Invention

This invention relates to a locking mechanism for electrical connector applied to connection of a wire harness for vehicles etc., provided with an engaging part being engaged with a locking part of a mating connector.

2. Description of the Related Art

FIG. 5 and FIG. 6 show an example (Japanese Non-examined Utility Model Application Publication No. Sho 64-49906) of prior art relevant to this kind of locking mechanism for connector.

As shown in FIG. 5, a pair of a male type connector 50 and a female type connector 60 are applied to various cables, such as a core wire of optical fiber. The male type connector 50 is provided with a male type connector housing 51 including an electric wire insertion hole (not shown) thereinto, an electric wire 70 of which an edge is inserted through the electric wire insertion hole, and a locking arm 53 is formed as protruding from an outer wall 51*a* of the male type connector housing 51 in a cantilever shape. The locking arm 53 comprises an operating part 54 for pressing, and a locking projection 55 located at a free end side succeeding to the operating part 54. An inclined surface 55*a*, which abuts against a fitting part 66 of the female type connector 60, is formed on the locking projection 55.

The female-type connector 60 is provided with a female type connector housing 61 including an engaging hood 64, a metal fitting 67 extended outside from an outer wall 61*a* of the female type connector housing 61, and the fitting part 66 formed on the engaging food 64.

In order that the male type connector 50 engages with the female type connector 60, the male type connector 50 is inserted into a engaging space 65 of the female type connector 60 while keeping the operating part 54 of the locking arm 53 pressed downward. Namely, pressing the operating part 54 downward allows the locking projection 55 to pass through the engaging space 65 with neither interference nor slidable contact with the engaging hood 64, thus a pair of connectors 50 and 60 can be engaged together with low insertion power.

In such an engaging state, when a pulling force acts on the connectors 50 and 60, the inclined surface 55*a* of the locking projection 55 abuts against the fitting part 66 of the engaging hood 64. Then, the locking projection 55 bends downward along the inclined surface 55*a* thereof. Then, the locking projection 55 comes out of the fitting part 66 and the engagement is released. Namely, the pair of connectors 50 and 60 can be unlocked easily by the pulling force. Therefore, such a locking mechanism prevents both the electric wire 70 from rupturing in the middle thereof and an electric wire connection part 56 fitting over an end of the electric wire 70 from being damaged.

However, in a conventional locking mechanism, such as above described, there is a problem to solve, as follows.

First, in engaging the connectors 50 and 60, when pressing down the locking arm 53 by depressing the operating part 54, the locking projection 55 is not moved perpendicularly with respect to a direction of connector engagement, but is moved inclinedly or in a circular orbit. Therefore, an engagement position between the locking projection 55 and the fitting part 66 may not be fixed. Thus, there is an anxiety that said engagement may be carried out with some play.

If such play exists, the pair of connectors 50 and 60 cannot retain tightness thereof. Especially in a waterproof connector, water droplets or dust may penetrate from a crevice therein to produce a poor connection so that the reliability of the electrical connection may be lost.

Additionally, there is another problem that engagement force of the pair of connectors 50 and 60 is weak. Namely, the inclined surface 55*a* is formed on the locking projection 55 of the locking arm 53. Thus, by pulling the electric wire 70 or connectors 50 and 60, the locking arm 53 bends downward, then the locking projection 55 comes out of the fitting part 66 and the engagement is released.

Therefore, in order to increase the engagement force of the pair of connectors 50 and 60, it is necessary to reduce resiliency of the locking arm 53 by increasing rigidity thereof, without modifying components-thereof. For attaining this, it is necessary that the locking arm 53 should have a thick body to improve section performance thereof. However, this structure makes a new problem that the locking arm 53 becomes larger and the male type connector 50 also becomes larger. Moreover, in engaging the pair of connectors 50 and 60 together, the locking projection 55 of the locking arm 53 rubs against an inner wall of the mating female type connector 60 and the insertion force required for joining the connectors 50 and 60 increases. Thus, the pair of connectors 50 and 60 cannot be engaged with each other smoothly.

Moreover, for releasing the engagement of the pair of connectors 50 and 60, it is necessary to extract the locking projection 55 from the fitting part 66 while bending the locking projection 55 of the locking arm 53 downward. However, if the locking arm 53 is hard to bend, the operating part 54 must be depressed with a strong power. Thus, operability of the locking arm 53 turns bad.

SUMMARY OF THE INVENTION

The present invention has been accomplished to solve the above-described problems and an object of the present invention is to provide a locking mechanism for an electrical connector that allows an engagement of connectors without any play, the engagement of connectors to prevent a reduction in engagement retaining power, and electrical terminals of the connectors to prevent a reduction in electrical contact quality.

In order to attain the above-described object, there is provided, according to a first aspect of the present invention, a locking mechanism of electrical connector that comprises one connector housing having a pair of projections facing with each other, one of the projections having a taper end, and the other connector housing having a locking part at a locking arm thereof, the locking part having an inverse taper rear end. In this locking mechanism, the locking part of the other connector housing is disposed in a space between the projections of the connector housing. Hereat, a front end of the locking part abuts against the taper end of the projection and the inverse taper rear end of the locking part abuts against an end of the other projection.

In this configuration, by inserting the locking part into the space between the pair of projections, clearance between the pair of projections and the locking part becomes zero. Thus, the play in the direction of the engagement of the connectors is canceled. Additionally, when the pulling force acts on the connector in the direction of the release of the connectors, the inverse taper rear end of the locking part thereof digs into the rear end of the projection of the other connector to improve a catch. Thus, this mechanism of the present invention prevents the connectors from being unlocked. Therefore, this mechanism prevents the reduction in the engagement retaining power and the reduction in the electrical contact quality. Additionally, this mechanism can prevent the connector from dropping out of the engagement. Thus, reliability of the lock of the connectors is improved.

Preferably, in the above described locking mechanism, the locking arm is supported by a middle fulcrum part and connecting parts. The middle fulcrum part is raised from the connector housing. The connecting parts connect to the connector housing. The locking part is positioned in between the middle fulcrum part and the connecting parts.

In this configuration, by supporting the locking arm by the middle fulcrum and the connecting parts, and by positioning the locking arm in between the middle fulcrum and the connecting parts, when the locking arm bends in an arch-shape, the locking part is not disposed in the direction of the engagement, but is disposed substantially perpendicularly. Thus, alignment of the locking part being engaged with the pair of projections can be done correctly. Therefore, by restricting the engagement position of the locking part, a locking mechanism of electric connector can be provided with high engagement reliability.

Preferably, in above-described locking mechanism, a gap is generated between a bottom of the space of the pair between projections, and the locking part, under the condition that the locking part is engaged with the pair of projections.

In this configuration, the gap is generated between the bottom of the space of the pair of projections and the locking part. Thus, the locking part is restrained by projections facing back and forth so as to stick thereto. Thus, the engagement of the connectors-has no-play. Therefore, problems, such as abrasion of the electric terminals or abnormal noise, are also dissolved.

DESCRIPTION OF THE PREFERRED EMBODIMENT

Figure 1:
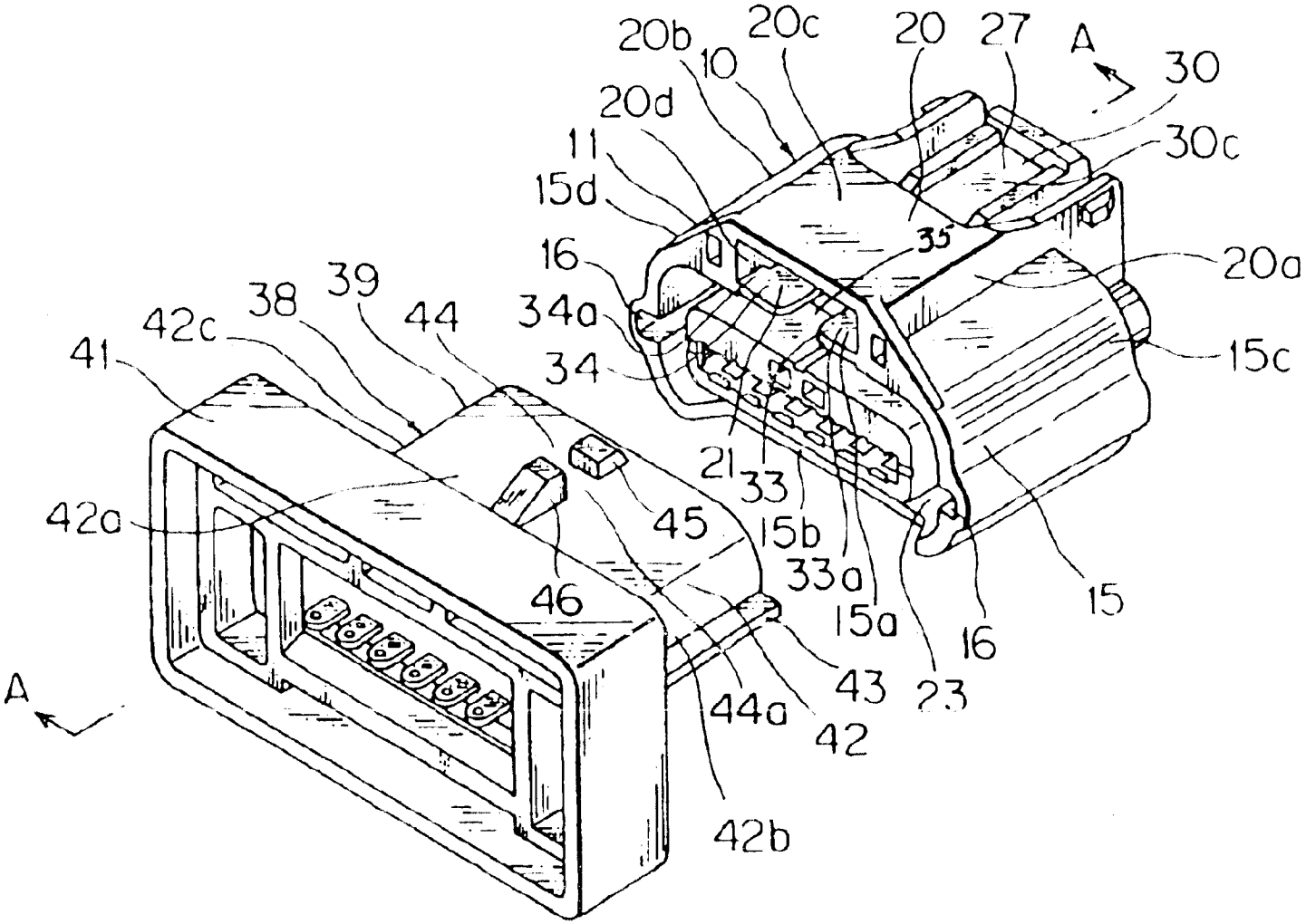
FIG. 1 is a perspective view showing a locking mechanism of electrical connector according to one embodiment of the present invention.

Now, an embodiment according to the present invention will be described in detail referring to the drawings. FIG. 1 to FIG. 4 shows one embodiment of a locking mechanism for electrical connector according to the present invention.

As shown in FIG. 1, a pair of connectors 10 and 38 are composed of a female connector (mating connector) 38 and a male connector 10. The female type connector 38 is provided with a female connector housing (one connector housing) 39 and male electric terminals (not shown) connected to electric wires (not shown). The male connector 10 is provided with a male connector housing (the other connector housing) 11 and female electric terminals (not shown) connected to electric wires.

Figure 2:
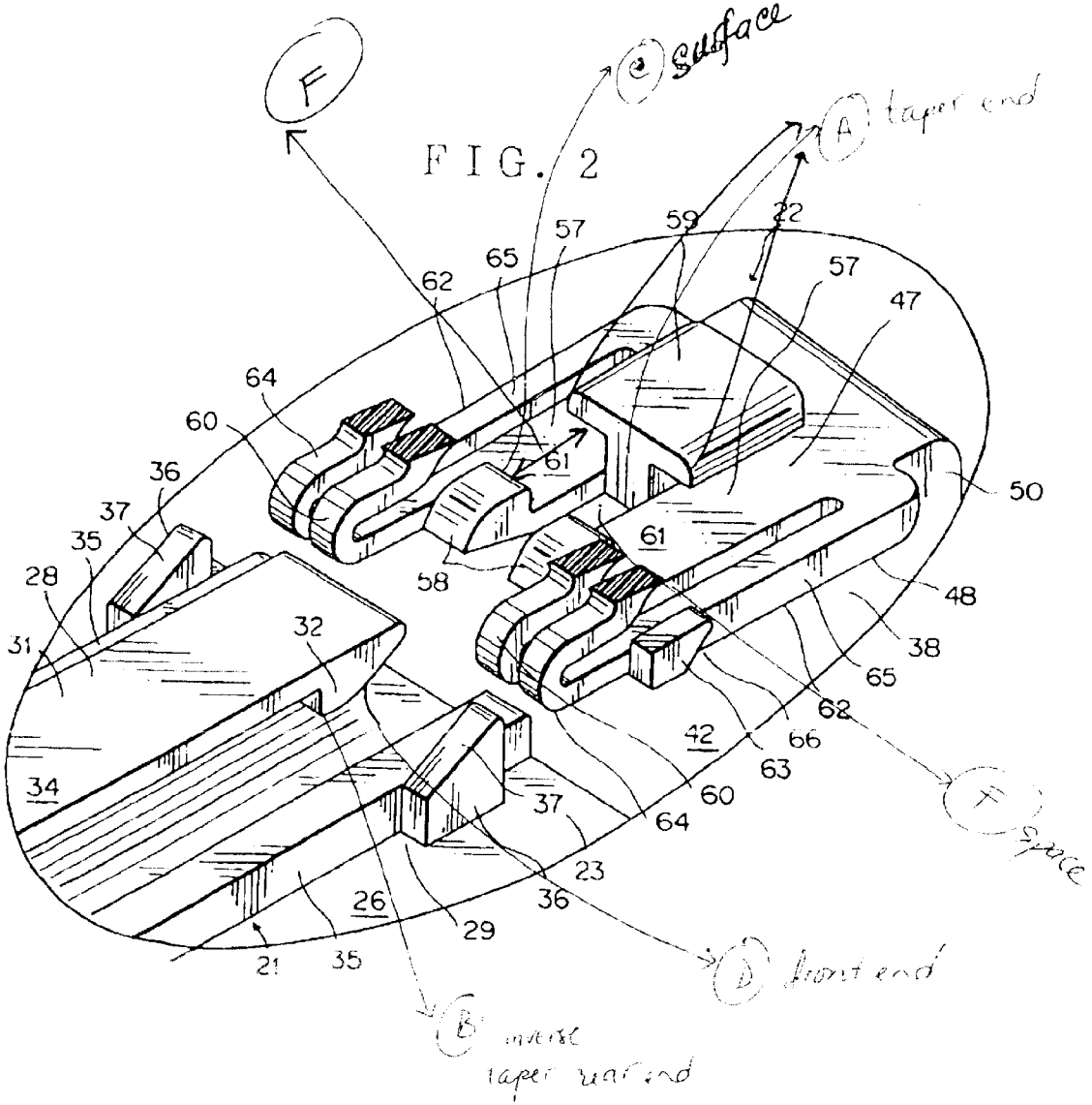
FIG. 2 is a cross-sectional view taken on line A—A of a male and female type connectors in FIG. 1.

As shown in FIG. 2, the female type connector housing 39 is composed of a engagement hood 42, which engages into an annular space of the male type connector housing 11, and a main female housing body 40 following the engagement hood 42. An engagement space 47 is formed inside the engagement hood 42. Male terminals re located in a backside of the engagement space 47.

Here, suppose that definitions of upper and lower, front and rear, and right and left in the male type connector 10 or the female type connector 38 are defined as follows on account of the explanation in this specification. About upper and lower, the definition may change by an arrangement of the male type connector housing 11 and the female type connector housing 39. However, a part where a locking arm 27 or an engagement part 44, which engages with the locking arm 27, is determined as an upper side for convenience. About front and rear, the mating male connector 10 or a part being engaged with the female type connector 38 is determined as a front side. About right and left, it is determined as a direction which male terminals or female terminals are arranged in parallel.

Figure 3:
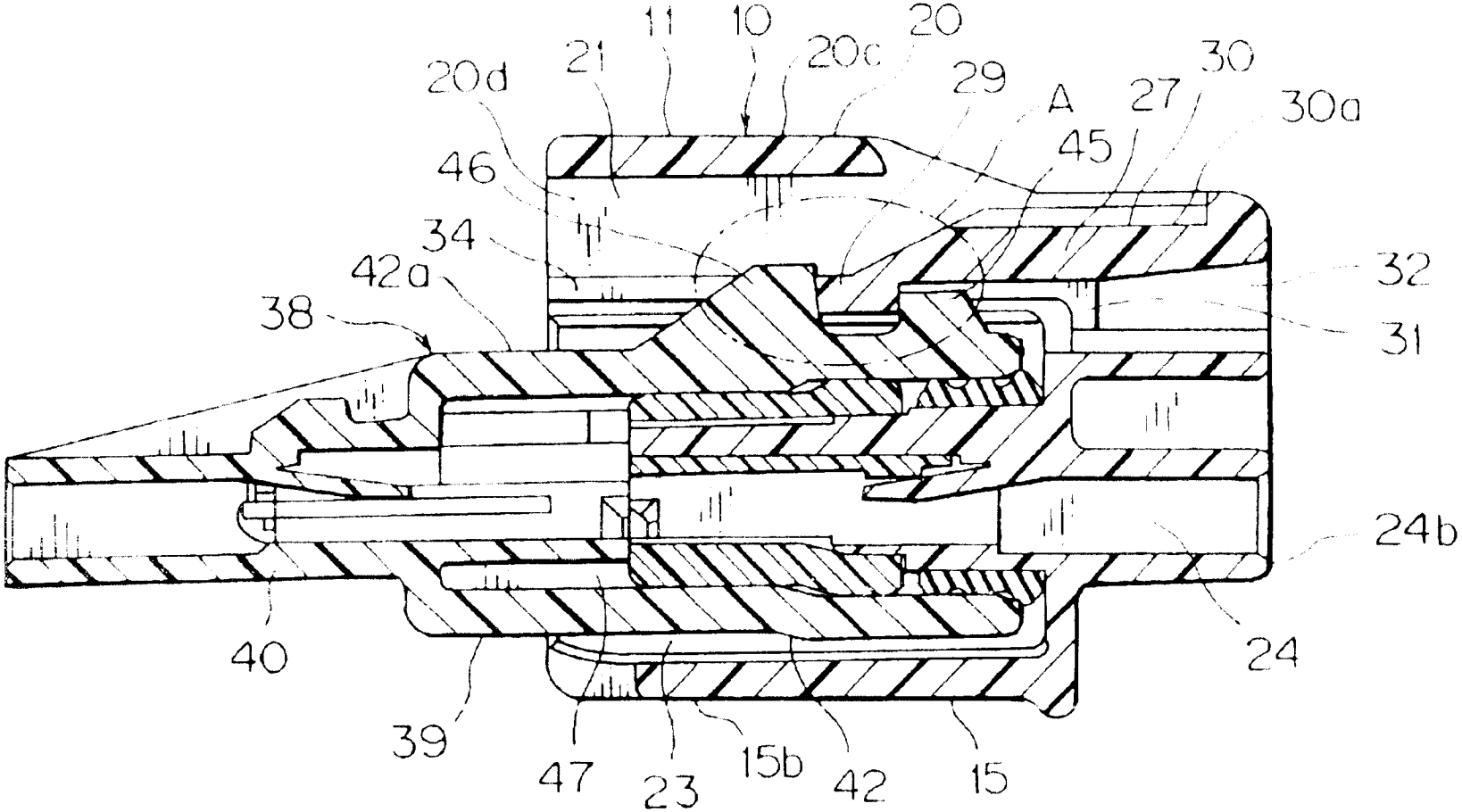
FIG. 3 is a cross-sectional view showing an engagement between the male type connector and the female type connector shown in FIG. 2.
Figure 4:
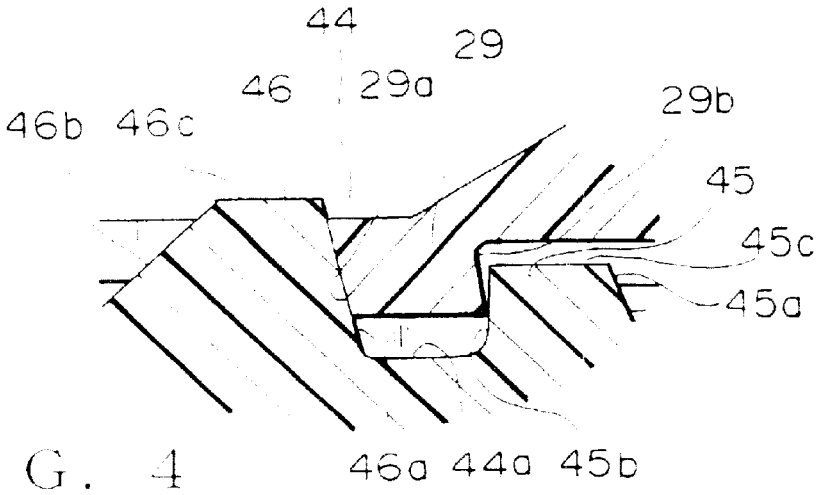
FIG. 4 is an enlarged view of the part A shown in FIG. 3.
Figure 5:
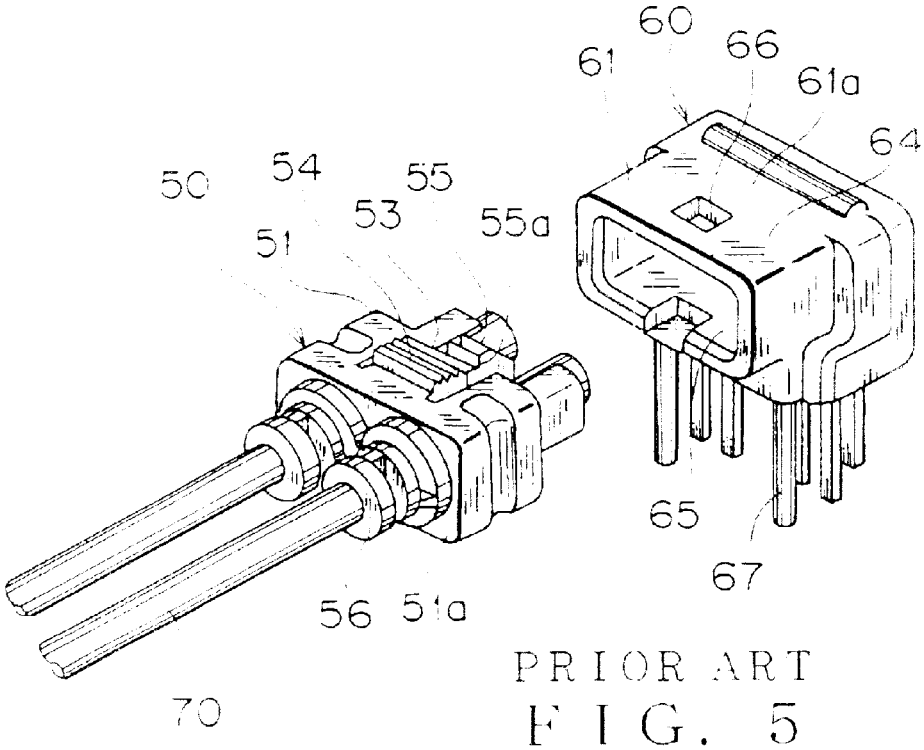
PRIOR ART FIG. 5
FIG. 5 is a perspective view showing an example of conventional locking mechanism for electrical connector.
Figure 6:
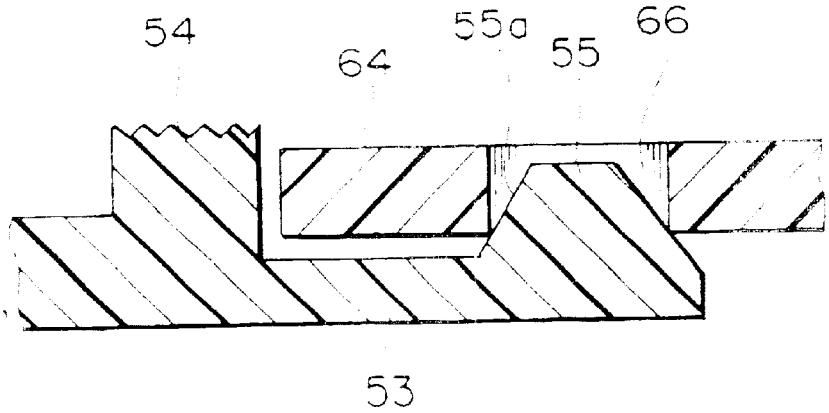
PRIOR ART FIG. 6
FIG. 6 is a cross-sectional view showing an engagement of a pair of connectors shown in FIG. 5.
Figure 6A:
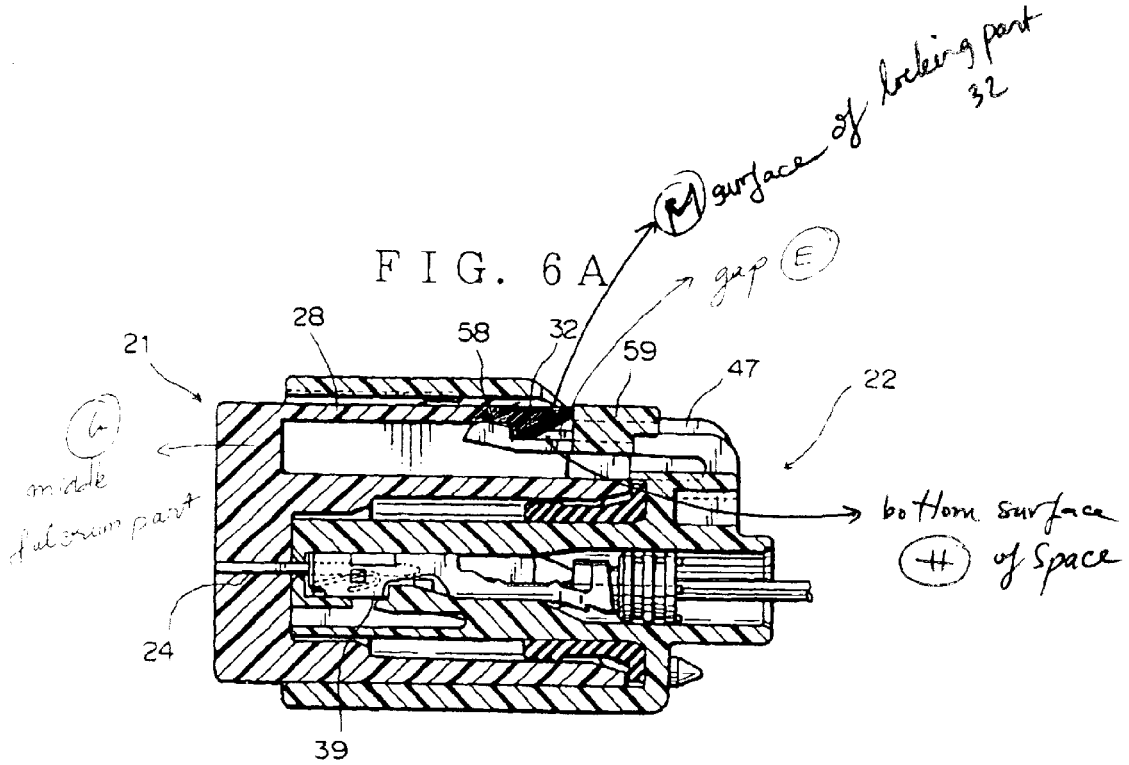
Figure 6B:
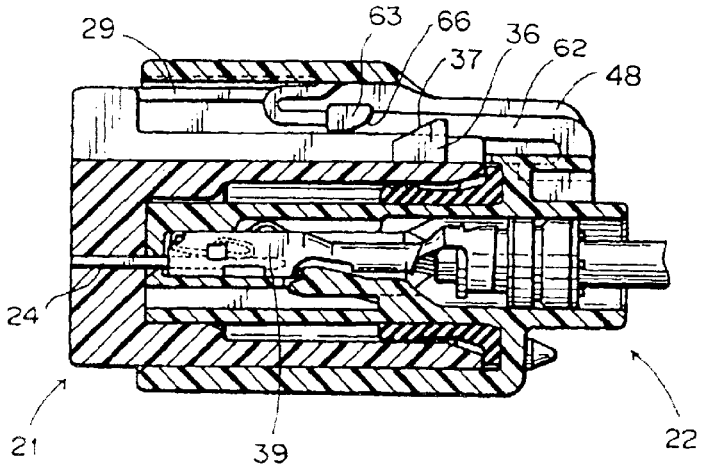

As shown in FIG. 3 and FIG. 4, on an upper wall 42*a* of an engagement hood 42, an engagement part 44 is provided at the position that corresponds to a locking projection 29 of the locking arm 27. The engagement part 44 is a valley formed between the front projection (wall part) 45 and the rear projection (wall part) 46. A pair of projections 45 and 46 is formed face to face, front and rear. The front projection 45 is a projection located in a front side of the engagement hood 42, and is formed lower than the rear projection 46. Because if the front projection 45 is projected highly, it may interfere with the locking projection 29 and the engagement part 44 cannot engage with the locking projection 29 smoothly.

A front surface 45*a* of the front projection 45 is a slope where the locking projection 29 runs aground. A rear surface 45*b* is a locking surface that locks a rear end surface 29*b* of the locking projection 29. An upper surface 45*c* of the front projection 45 is formed in a flat surface.

The rear projection 46 is separated from and located at a predetermined interval behind the front projection 45. A front surface 46*a* of the rear projection 46 has a slope that slidably contacts a front surface 29*a* of the locking projection 29. A degree of angle of gradient of the front surface 46*a* is set as the same angle as the degree of angle of gradient of the front surface 29*a* of the locking projection 29. Although a rear surface 46*b* of the rear projection 46 has a slope that inclines at an arbitrary degree of angle of gradient, a vertical plane is also acceptable. An upper surface 46*c* of the rear projection 46 is formed in a flat surface parallel to the upper surface 45*c* of the front projection 45.

The engagement part 44 consists of a bottom surface 44*a*, the rear surface 45*b* of the front projection 45, and the front surface 46*a* of the projection 46 opposite to the rear surface 45*b* in a rear side. An interval of the engagement part 44 is set as a size with which clearance does not occur in a longitudinal direction when the projections 45 and 46 are engaged with the locking projection 29. Namely, the rear end surface 29*b* of the locking projection 29 abuts against the rear surface 45*b* of the front projection 45. And the front surface 29*a* of the locking projection 29 abuts against the front surface 46*a* of the rear projection 46. Thus, the interval of the engagement part 44 is set as a size with which the locking projection 29 does not shake in the longitudinal direction.

Again as shown in FIG. 1, the guide rib 43 for prevention of positional displacement when engaging a pair of connectors 10 and 38 is provided in side walls 42*b* and 42*c* of the both sides of the engagement hood 42. The guide rib 43 is formed across the longitudinal direction of the engagement hood 42. Because the guide rib 43 advances into a guide slot 16 of the male connector 10, the play at the time of engagement can be prevented. Thus, the pair of connectors 10 and 38 can be smoothly engaged with each other.

The male type connector housing 11 is equipped with a main housing part 12 in which a terminal accommodation room 24 is formed, a hood part 15 of the outside of the main housing part 12, and the locking arm 27 which faces an annular space 23 inside the hood part 15.

A rectangular pipe-shaped expanded wall 20 is formed outside the hood part 15. The expanded wall 20 is equipped with side wall parts 20*a* and 20*b* raised from side walls 15*c* and 15*d* of both sides to the upper part, and an upper wall part 20*c* which connects with the side wall parts 20*a* and 20*b* of both sides. The side wall parts 20*a* and 20*b* of both sides extend backward to connect with the main housing part 12. A space defined by the side wall parts 20*a* and 20*b*, and the upper wall part 20*c* is a bend space 21 for the locking arm 27. In a last half of the bend space 21, the upper wall part 20*c* is formed as an opening, and an operating part 30 of the locking arm 27 is exposed.

A guide slot 16 corresponding to a guide rib 43 is provided on the each side wall of 15*c* and 15*d* of the hood part 15. This guide slot 16 extends in the full length of the longitudinal direction of the hood part 15.

An annular space 23 is formed in a shape corresponding to the engagement hood 42 of the female type connector housing 39. When the annular space 23 is too large, there is a danger of penetration of water droplets, dirt, or so on. When the annular space 23 is too small, the pair of connectors 10 and 38 cannot engage with each other smoothly. Thus, the size of the annular space 23 is defined in consideration of the sealing performance of the set of connectors 10 and 38.

The main housing part 12 is formed inside the annular space 23. In the main housing part 12, a lattice-like terminal accommodation room 24 (FIG. 2) is partitioned. Six female type terminals to which the electric wire is connected are accommodated in the terminal accommodation room 24.

Openings are partially formed in a front end surface 24*a* and a rear end surface 24*b* of the terminal accommodation room 24 (FIG. 2). The male type terminal having an electric tab-like contact part can be inserted into an inner part of the terminal accommodation room 24 from the opening of the front-end surface 24*a* to connect with an electric contact part of the female type terminal electrically. The female type terminal can be inserted into the terminal accommodation room 24 from the opening of the rear end surface 24*b*.

As shown in FIG. 2, the locking arm 27 having the locking projection 29 engages with the pair of projections 45 and 46 of the female type connector housing 39 to lock the pair of connectors 10 and 38, facing the annular space 23. The locking arm 27 is equipped with a body part 28 having the locking projection 29, the operating part 30 for pressing formed in the rear side of the body part 28, and a pair of legs (connecting part) 33 and 34 formed in the front side of the body part 28. Additionally, the locking arm-27 extends in the engaging direction of the pair of connectors 10 and 38 intermediate the width direction of the male type connector housing 11.

The legs 33 and 34 include the shapes of uniform thin plate, and serve as parts of the wall forming the annular space 23 (FIG. 1). Respective end support parts 33*a* and 34*a* of the legs 33 and 34 connect with an inner side wall 20*d* of inner side walls of the expanded wall 20 (FIG. 1) preventing an end of the locking arm 27 from bending vertically. The body part 28 is formed near root parts of the pair of legs 33 and 34.

The locking projection 29 is formed on an under surface 28*b* of the body part 28, and is located in the middle fulcrum part 31 described later and the end support parts 33*a* and 34*a*. The position of the locking projection 29 is defined in consideration of the on-the-strength balance of the locking arm 27 so that the locking projection 29 can be displaced in a direction perpendicular to the direction of the engagement of connectors 10 and 38. Therefore, by pressing the operating part 30 downward, the locking projection 29 moves up and down without shifting forward and backward to be aligned with the engagement part 44 correctly.

As shown in FIG. 4, the cross-sectional form of the locking projection 29 includes the shape of a parallelogram. That is, the front surface 29*a* and the rear end surface 29*b* are formed leaning at a predetermined angle to the direction of engagement of the pair of connectors 10 and 38. An angle of inclination of the front surface 29*a* is set as the same angle of inclination as the front surface 46*a* of the rear projection 46. The rear end surface 29*b* is an inverse taper side so as to prevent the connectors 10 and 38 from releasing the engagement and the angle of inclination thereof is arbitrary.

As shown in FIGS. 2 and 3, the operating part 30 is formed with a slope that goes up gradually to the rear side of the body part 28. A middle fulcrum part 31 supporting the locking arm 27 is formed to extend downward from an under surface 30*b* of the operating part 30. The middle fulcrum part 31 is connected to the main housing part 12. A gap 32 is formed under the operating part 30, and it is possible to press the operating part 30 downward owing to this gap 32.

The locking arm 27 is supported by the middle fulcrum part 31 formed on the under surface 30*b* of the operating part 30, and the pair of end support parts 33*a* and 34*a* connected with the inner side wall 20*d* of the expanded wall 20 (FIG. 1). Thus, posture stability of the locking arm 27 is improved by the locking arm 27 being supported in the longitudinal and transverse direction.

Especially, the power committed in the end support parts 33*a* and 34*a* by the principle of a lever is distributed in the two directions by supporting the end support parts 33*a* and 34*a* of the locking arm 27 by two points of right and left. Therefore, the posture stability of the locking arm 27 is improved remarkably.

Therefore, the position of the locking projection 29 formed with a projecting shape in the under surface 28*b* of the body part 28 is also prevented from shifting in the longitudinal and transverse direction. Thus, it is possible to engage the pair of connectors 10 and 38 with each other tightly without any play.

When engaging the male type connector 10 with the female type connector 38, the female type connector 38 engages into the annular space 23 of the male type connector 10. Then, the front projection 45 ahead of the female type connector 38 advances into the backside of the annular space 23, being guided in a slide slot 35 of the male type connector 10. At this time, the front surface 29*a* of the locking projection 29 initially abuts against the front surface 45*a* of the front projection 45 and the advance is once suspended.

And when this abutting force increases, the body part 28 including the locking projection 29 rises along an arc-shaped path with an inertia lock by the principle of the lever which uses the middle fulcrum part 31 as a fulcrum. Then, the locking projection 29 is caused to follow the contour of the front projection 45, and being restored resiliently downwardly, the front surface 29*a* of the locking projection 29 is received in the space between the projections 45 and 46 which define the engagement part 44 while slidably abutting against the front surface 46*a* of the rear projection 46. Simultaneously, the rear end surface 29*b* of the locking projection 29 abuts against the rear surface 45*b* of the front projection 45, and the lock of connectors 10 and 38 is completed whereby between the locking projection 29 and the cooperating front and rear projections 45, 46 is prevented.

Additionally, to release the lock of the male type connector 10 and the female type connector 38, the operating part 30 of the locking arm 27 is pressed downward to make the body part 28 including the locking projection 29 rise upwardly along an arcuate path. Then, the engagement between the locking projection 29 and the engagement part 44 is released to cancel the lock.

What is claimed is:

1. A locking mechanism for an electrical connector assembly including a pair of connector housings which are relatively movable in a direction for connection and disconnection thereof, comprising:

a first connector housing having a pair of fixed projections spacedly disposed in said direction for connection and disconnection of said connector housings, said projections having mutually spaced, oppositely facing surfaces to form a locking space therebetween, a second connector housing having a resilient locking arm containing a locking part defined by a projection operative for insertion into said locking space of said first connector housing, said locking part projection containing one surface facing in the direction for connection of said connector housing and being adapted for substantially face-to-face engagement with an oppositely facing surface of a cooperating one of said fixed projections and another surface, directed oppositely from said one surface and being inclined at an acute angle with respect to a base of said locking projection to define a locking edge facing in the direction of disconnection of said connector housings that digs into the facing surface of the another fixed projection when said locking part projection is depressed into the locking space between said fixed projections.

2. The locking mechanism for an electrical connector assembly in claim 1 in which said facing surfaces of said fixed projections are substantially mutually divergent.

3. The locking mechanism for an electrical connector assembly as claimed in claim 1 further comprising a pair of connecting parts formed in a front side of said second connector housing, wherein said locking arm is supported by a middle fulcrum part raised from said second connector housing and said connecting parts connecting said locking arm to said second connector housing, wherein said locking part is positioned in between the middle fulcrum part and the connecting parts.

4. The locking mechanism for an electrical connector assembly as claimed in claim 1 or claim 3, wherein a gap is formed between a bottom surface of the space between said pair of projections of said first connector and a surface of said locking part of said second connector, said surfaces facing each other, under the condition of said locking part being engaged with said pair of projections.

* * * * *